US008869756B2

(12) United States Patent
Bilezikjian et al.

(10) Patent No.: US 8,869,756 B2
(45) Date of Patent: Oct. 28, 2014

(54) COOLING SYSTEM AND METHOD FOR A VEHICLE ENGINE

(75) Inventors: John P. Bilezikjian, Canton, MI (US); Kenneth J. Jackson, Dearborn, MI (US); Valerie Anne Nelson, Livonia, MI (US); Thomas J. Cusumano, Royal Oak, MI (US); Elmer S. Foster, Ypsilanti, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 1574 days.

(21) Appl. No.: 12/331,456

(22) Filed: Dec. 10, 2008

(65) Prior Publication Data

US 2010/0139582 A1 Jun. 10, 2010

(51) Int. Cl.

| | |
|---|---|
| ***F01P 7/00*** | (2006.01) |
| ***F01P 7/16*** | (2006.01) |
| *F01P 3/02* | (2006.01) |
| *F01P 5/10* | (2006.01) |
| *F01P 5/12* | (2006.01) |

(52) U.S. Cl.

CPC ..... *F01P 3/02* (2013.01); *F01P 2060/08* (2013.01); *F01P 7/164* (2013.01); *F01P 2003/028* (2013.01); *F01P 2005/105* (2013.01); *F01P 2003/027* (2013.01); *F01P 2025/33* (2013.01); *F01P 2005/125* (2013.01)

USPC ..... 123/41.02; 123/41.44; 123/41.42

(58) Field of Classification Search

USPC ..... 123/41.02, 41.44, 41.42, 41.11, 41.01

See application file for complete search history.

(56) References Cited

U.S. PATENT DOCUMENTS

| | | | | | |
|---|---|---|---|---|---|
| 2,488,261 | A | * | 11/1949 | Bedini | 128/201.11 |
| 3,488,261 | A | * | 1/1970 | Loebel | 203/26 |
| 3,877,443 | A | | 4/1975 | Henning et al. | |
| 4,249,491 | A | | 2/1981 | Stein | |
| 4,381,736 | A | * | 5/1983 | Hirayama | 123/41.1 |
| 4,381,739 | A | * | 5/1983 | Fisher | 123/53.4 |
| 4,413,596 | A | | 11/1983 | Hirayama | |
| 4,648,357 | A | | 3/1987 | Hayashi | |
| 4,759,316 | A | | 7/1988 | Itakura | |
| 5,036,803 | A | | 8/1991 | Nolting et al. | |
| 5,095,855 | A | | 3/1992 | Fukuda et al. | |
| 5,215,044 | A | * | 6/1993 | Banzhaf et al. | 123/41.29 |
| 5,353,757 | A | * | 10/1994 | Susa et al. | 123/41.29 |
| 5,497,941 | A | | 3/1996 | Numazawa et al. | |
| 5,551,384 | A | * | 9/1996 | Hollis | 123/142.5 R |
| 5,743,466 | A | | 4/1998 | Humburg | |
| 5,794,575 | A | * | 8/1998 | Sonnemann et al. | 123/41.08 |
| 5,860,595 | A | * | 1/1999 | Himmelsbach | 237/12.3 B |
| 5,996,762 | A | | 12/1999 | Edelmann et al. | |
| 6,017,200 | A | * | 1/2000 | Childs et al. | 417/404 |

(Continued)

FOREIGN PATENT DOCUMENTS

JP 2005248854 9/2005

*Primary Examiner* — Noah Kamen
*Assistant Examiner* — Long T Tran
(74) *Attorney, Agent, or Firm* — Carlson, Gaskey & Olds, P.C.

(57) ABSTRACT

The present invention relates to a cooling system for an internal combustion engine. The cooling system can be used in a hybrid electric vehicle. The system includes electric pumps in fluid communication with the engine and a control unit that governs the pumps. The pumps can be configured to supply fluid to either a cylinder block or cylinder head and backflow fluid through either the cylinder block or cylinder heads. Various arrangements of electrical and mechanical pumps are disclosed to control fluid flow and pressure.

19 Claims, 12 Drawing Sheets

(56) References Cited

U.S. PATENT DOCUMENTS

| | | | | |
|---|---|---|---|---|
| 6,035,830 | A * | 3/2000 | Saito | 123/457 |
| 6,035,930 | A * | 3/2000 | Schwartz | 165/169 |
| 6,199,518 | B1 | 3/2001 | Hotta et al. | |
| 6,247,429 | B1 | 6/2001 | Hara et al. | |
| 6,454,621 | B2 * | 9/2002 | Matsuda | 440/88 R |
| 6,532,911 | B2 | 3/2003 | Suzuki et al. | |
| 6,601,545 | B1 | 8/2003 | Hohl | |
| 6,786,183 | B2 | 9/2004 | Hoelle et al. | |
| 6,793,874 | B2 * | 9/2004 | Ly et al. | 266/241 |
| 6,810,838 | B1 | 11/2004 | Hellman | |
| 6,913,000 | B2 * | 7/2005 | Hasegawa et al. | 123/508 |
| 7,000,574 | B2 * | 2/2006 | Ahner et al. | 123/41.12 |
| 7,032,546 | B2 | 4/2006 | Kaya et al. | |
| 7,243,620 | B2 * | 7/2007 | Takahashi | 123/41.1 |
| 2001/0045103 | A1 * | 11/2001 | Khelifa | 62/244 |
| 2002/0011221 | A1 * | 1/2002 | Suzuki et al. | 123/41.14 |
| 2004/0011305 | A1 * | 1/2004 | Herynek et al. | 123/41.02 |
| 2005/0047284 | A1 * | 3/2005 | Takagi | 369/13.14 |
| 2005/0144949 | A1 | 7/2005 | Hamada et al. | |

* cited by examiner

COOLING SYSTEM AND METHOD FOR A VEHICLE ENGINE

TECHNICAL FIELD

The present invention relates to a cooling system for an internal combustion engine. The cooling system can be used in a hybrid electric vehicle.

BACKGROUND

Automobile engines can generate a significant amount of heat during operation. Conventional cooling systems for engines include water pumps that circulate water or other coolants throughout the engine. Mechanical pumps (e.g., belt, chain or gear pumps) are popularly used in internal combustion engines. The pumps are driven by the rotational force of the engine crank shaft. Consequently, it is difficult to adjust or control the pump flow rate without adjusting the engine speed.

Additionally, there can be substantial parasitic losses when using mechanical pumps to cool the engine. Parasitic loss reductions can improve the fuel economy of internal combustion engine vehicles. Electric water pumps can be more efficient than mechanical pumps. For example, electric pumps can be controlled to reduce pump performance in instances where there is less demand on the cooling system. Flow requirements of larger engines and limited passage ways, however, can make the use of electric pumps prohibitively expensive, large and heavy.

Lastly, packaging the cooling system for an engine can be limited by other components of the vehicle. With larger engines requiring higher flow and pressure demands, larger pumps significantly increase the required packaging space.

Therefore, it is advantageous to reduce parasitic losses due to pumping coolant throughout the vehicle cooling system due to mechanically driven water pumps. It is also advantageous to provide a cooling system that can be packaged in smaller spaces.

SUMMARY

According to one exemplary embodiment, a cooling system for an internal combustion engine, the internal combustion engine having a cylinder block and cylinder head, includes: a first pump in fluid communication with the engine, the first pump being an electric pump; a second pump in fluid communication with the engine, the second pump being an electric pump; and a control unit that governs the first pump and second pump. At least two fluid return channels are configured to recirculate coolang to the pumps. The first pump is configured to supply coolant to the cylinder head and the second pump is configured to supply coolant to the cylinder block. The first and second pumps are arranged to backflow coolant through the engine.

In another exemplary embodiment, a cooling system for an internal combustion engine includes: at least three electrical water pumps arranged in parallel with respect to each other and configured to provide water to the ICE; a mechanical water pump in fluid communication with the three electrical water pumps and configured to provide water to the ICE; and a control unit that governs the electrical water pumps.

One of the advantages of the present invention is an increased aggregate flow and pressure for the cooling system. The use of multiple pumps enables greater flexibility in adjusting or controlling the flow and pressure of the cooling system.

Another advantage of the present invention is that it requires less packaging space than one large pump. The arrangement of the pumps is also more flexible than a singular pump design. The use of a multiple smaller pumps in production reduce the overall part cost of each pump.

The invention will be explained in greater detail below by way of example with reference to the figures, in which the same references numbers are used in the figures for identical or essentially identical elements. The above features and advantages and other features and advantages of the present invention are readily apparent from the following detailed description for carrying out the invention when taken in connection with the accompanying drawings. In the figures:

DETAILED DESCRIPTION

Figure 6:
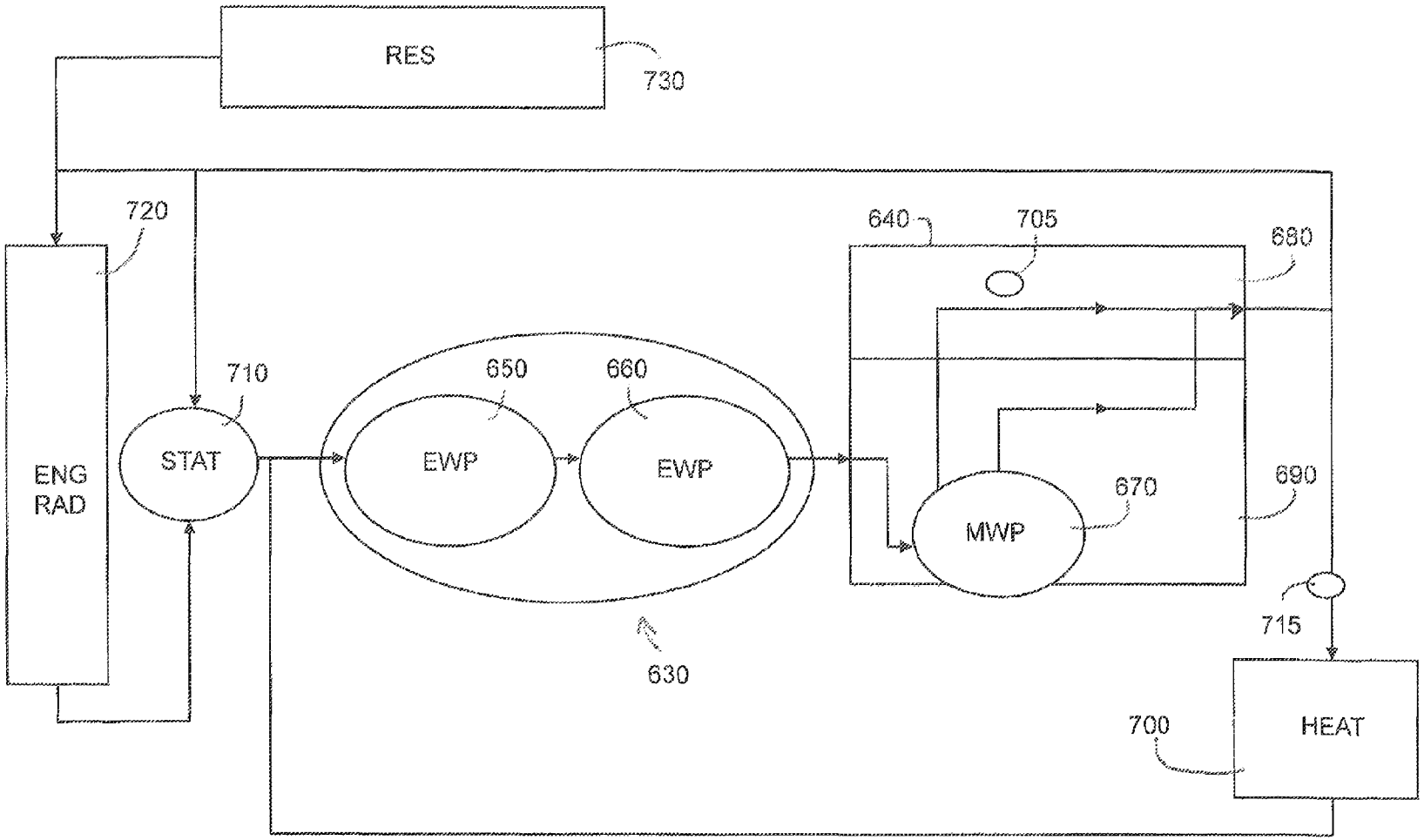
FIG. 6 is a schematic depiction of a cooling system and internal combustion engine according to an exemplary embodiment of the present invention.
Figure 7:
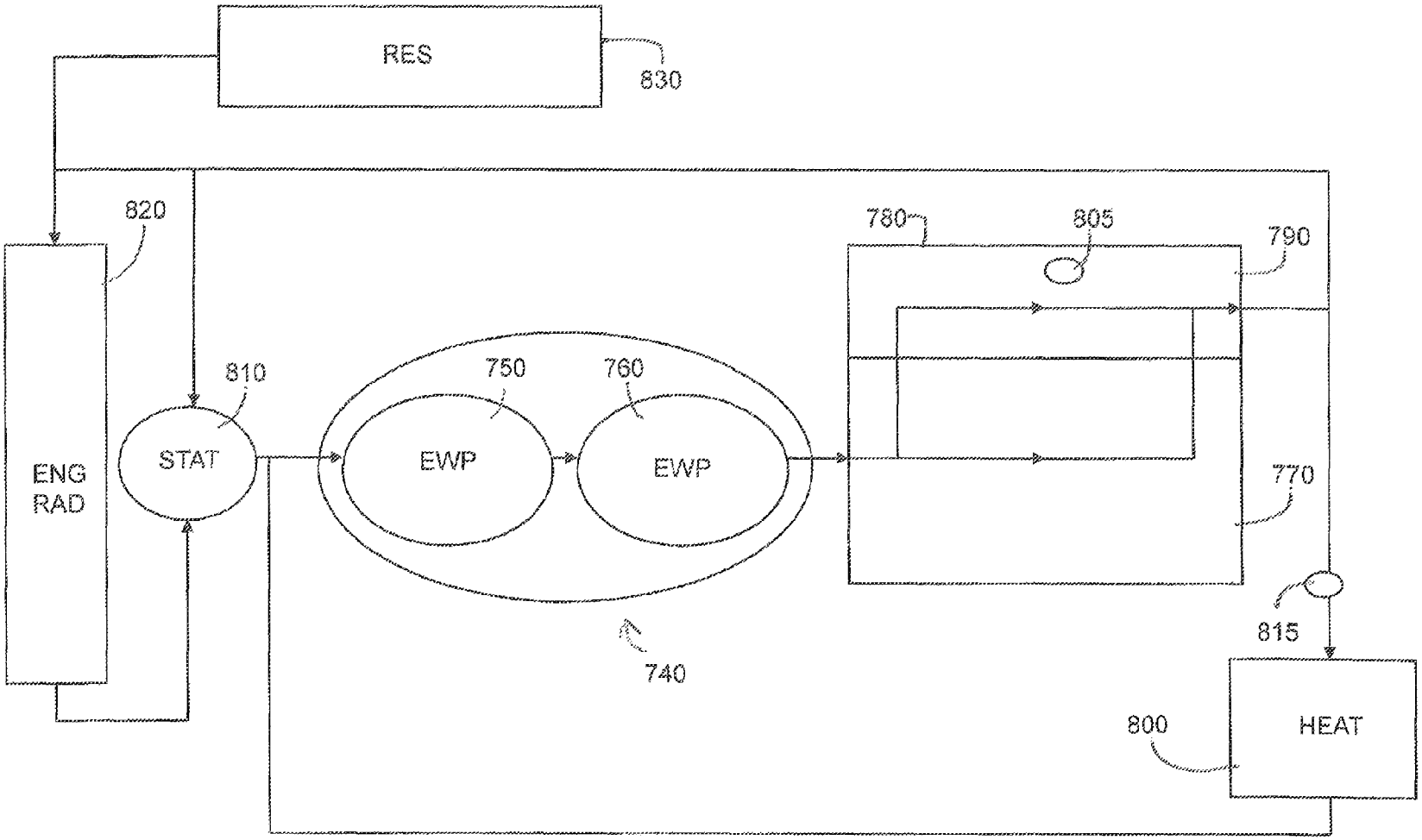
FIG. 7 is a schematic depiction of a cooling system and internal combustion engine according to an exemplary embodiment of the present invention.
Figure 8:
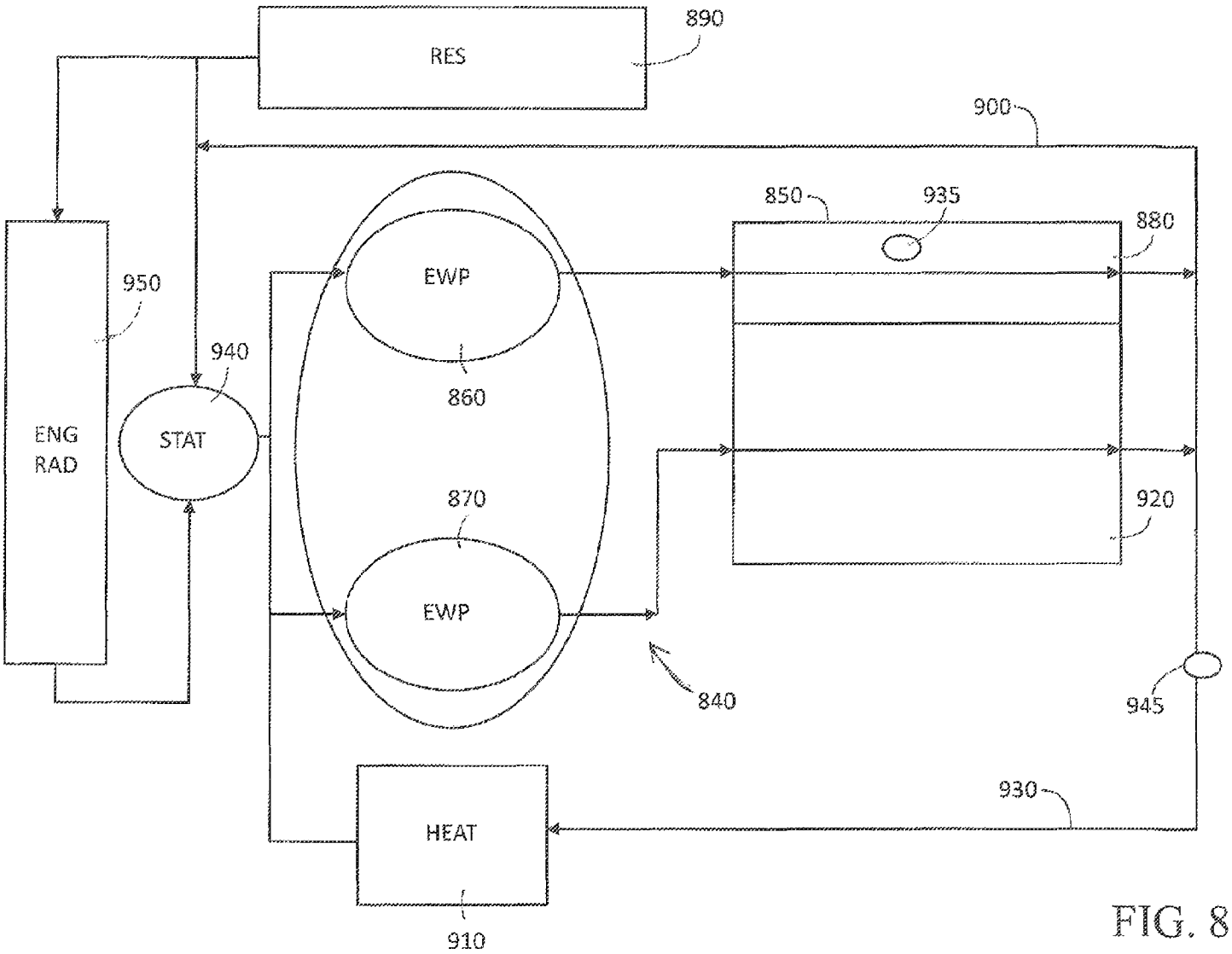
FIG. 8 is a schematic depiction of a cooling system and internal combustion engine according to an exemplary embodiment of the present invention.

Referring to the drawings, FIGS. 1-9, wherein like characters represent the same or corresponding parts throughout the several views there is shown cooling systems 10, 120, 230, 400, 520, 630, 740 for use with a vehicle engine. The vehicle can be a hybrid electric vehicle. The cooling systems include a number of electrical pumps in fluid communication with the engine. A control unit 840 is provided, as shown in FIG. 8, that controls the distribution of fluid between the pumps and the engine. The engines shown in the illustrated embodiments are internal combustion engines. The techniques disclosed herein can be used with various internal combustion engines including, for example, V-4, V-6, V-8, V-10 or in-line arrangements. Other engines (e.g., Wankel or other internal combustion engine configurations) can also be used with the cooling system disclosed herein.

Figure 1:
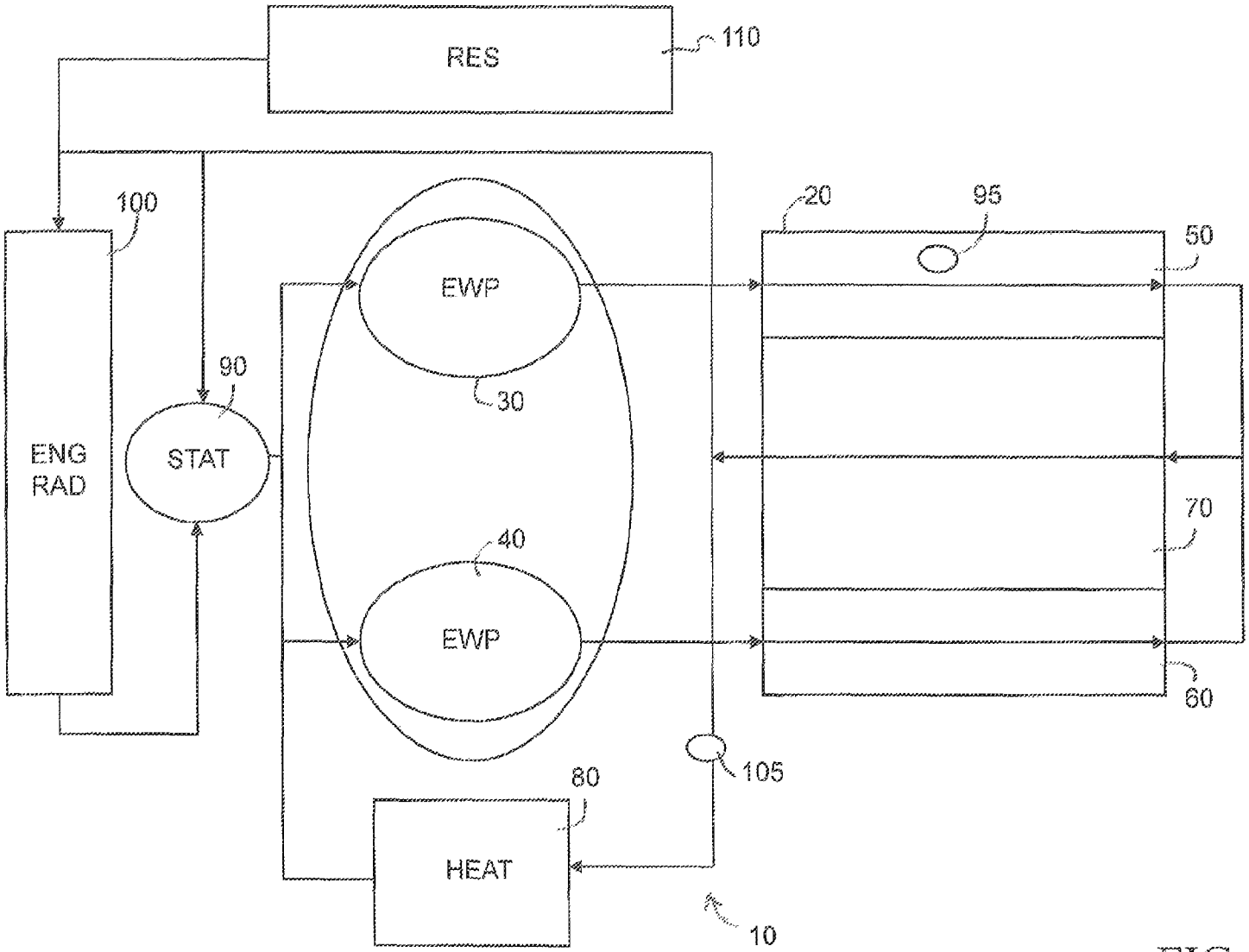
FIG. 1 is a schematic depiction of a cooling system and internal combustion engine according to an exemplary embodiment of the present invention.

With reference to FIG. 1, there is shown a cooling system 10 and internal combustion engine 20. Cooling system 10 provides greater flexibility and control of the thermal conditions of the engine 20 during operation than contemporary designs with singular and/or mechanical water pumps. The illustrated cooling system 10 utilizes water as a coolant, other lubricants or coolants can be employed with the present teachings. E.g., in one embodiment, oil or antifreeze is utilized with the cooling system 10.

Cooling system 10, as shown in FIG. 1, includes two electrical water pumps (or "EWPs") 30, 40. Engine 20 is a v-type engine (e.g., a V-8). Engine 20 includes a first cylinder head 50 and second cylinder head 60. The cylinder heads 50, 60 are mounted atop a cylinder block 70. Each cylinder head 50, 60 has a pump dedicated to that head. Pump 30 is in fluid communication with the first cylinder head 50. Pump 30 selectively supplies fluid to the first cylinder 50 head upon command. Pump 40 is configured to provide fluid to the second cylinder head 60. Cooling system 10 includes a control system (e.g., like the control system 840 shown in FIG. 8). Control system governs the performance of pumps 30 and 40.

Pumps 30, 40 are configured in a parallel arrangement with respect to each other. In this configuration pumps 30, 40 provide greater flexibility and capability with respect to fluid flow rate. Fluid pressure is not necessarily increased at the same rate that flow rate is increased. Engines with greater flow demands than pressure requirements can utilize the shown cooling system 10.

Fluid is circulated through the cylinder block 70 from the cylinder heads 50, 60. In this embodiment, fluid is flown in a direction opposite of a natural flow of fluid in a backflowing process. E.g., fluid can be directed upward from the base of the cylinder block 70 to an upper portion of the cylinder block. Backflowing enables more efficient use of the fluid or coolant. Various engine components can be cooled with the same fluid without providing additional pumping mechanisms for each engine component. In some instances, backflowing can reduce corrosion of components and lead to greater thermal cooling. In FIG. 1, the cooling system 10 is configured to directly supply fluid to the cylinder heads 50, 60 and backflow fluid through the cylinder block 70.

The fluid exiting the engine is provided to a heater core 80. Heater core 80 can add or remove thermal energy from fluid. Heater core 80 can be controlled by a control unit that can be the same or separate from the cooling system control unit. In one embodiment, a heater control valve is connected to the control unit and used to control the heater core 80. In another exemplary embodiment, a fan or blender is used to control the heater core 80. Heater 80 can be any standard heater known within the field, e.g., radiator. Fluid dispensed from the heater core is directed back into pumps 30, 40.

A thermostat 90 is included in the cooling system 10. The thermostat 90 is in fluid communication with an engine radiator 100. Thermostat 90 controls flow to the radiator 100 to remove excess heat from the fluid. Thermostat 90 can be any standard thermostat known within the field.

In the illustrated embodiment, thermostat 90 can be in communication with temperature sensors (e.g., 95, 105 as shown in FIG. 1) configured to gauge the temperature of fluid. In the shown embodiment, sensor 95 is configured to measure the temperature of fluid in the cylinder head. Sensor 105 is configured to measure fluid on the hot side of the engine as it exits the engine block. Sensors 95, 105 can be placed at various points with respect to the engine, including but not limited to the hot/cold sides of the engine, the cylinder head or locations with oil traveling therethrough. For example, temperature sensors can measure the temperature of fluid exiting the engine radiator. In one embodiment, the control unit governs the performance of pumps 30 and 40 according to the temperature readings from the temperature sensor. For example, if the fluid exiting engine 20 exceeds a predetermined threshold temperature of 120° C. pumps can be instructed to increase their flow output. Where the temperature of fluid drops below another predetermined temperature (e.g., 80° C.) one or more pumps 30, 40 can performed at a reduced speed, flow or power level. In another example, a temperature sensor measures the temperature of the cylinder heads 50, 60. Where the cylinder heads 50, 60 exceed a temperature of 300° C. pumps can be instructed to increase their flow output.

In the shown embodiment, a fluid reservoir 110 is provided. The fluid reservoir 110 is in fluid communication with the cooling system 10 through the engine radiator 100. When desired, fluid in reservoir 110 is circulated to the engine radiator 100. Engine radiator 100 is in fluid communication with thermostat 90. Engine radiator 100 can be any type of radiator known within the field.

Figure 2:
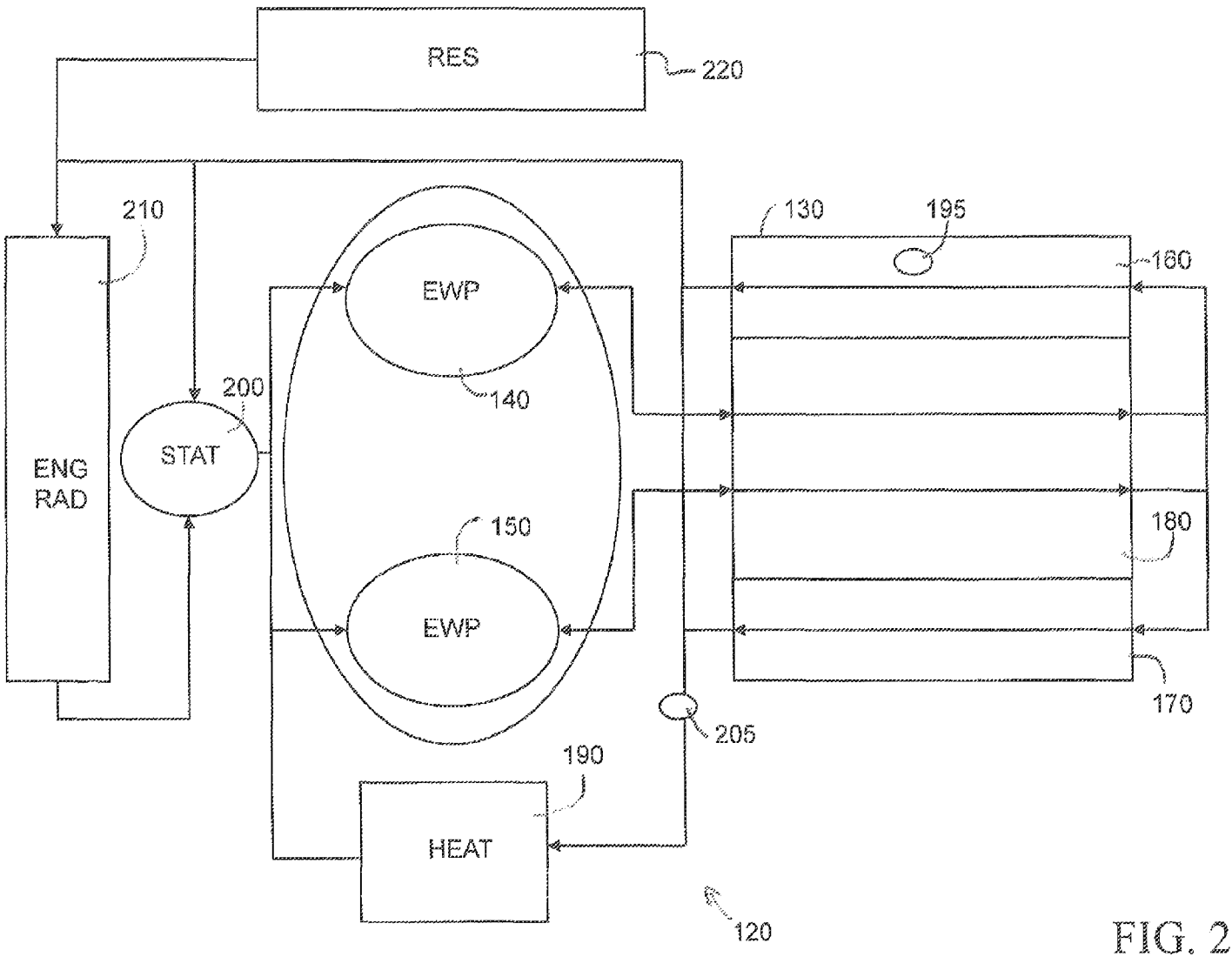
FIG. 2 is a schematic depiction of a cooling system and internal combustion engine according to an exemplary embodiment of the present invention.

With reference to FIG. 2, there is shown a cooling system 120 and internal combustion engine 130. The illustrated cooling system utilizes water as a coolant, other lubricants or coolants can be employed with the present teachings. E.g., in one embodiment, oil or antifreeze is utilized with the cooling system 120.

Cooling system 120, as shown in FIG. 2, includes two electrical water pumps 140, 150. Engine 130 is a v-type engine (e.g., a V-8). Engine 130 includes a first cylinder head 160 and second cylinder head 170. The cylinder heads 160, 170 are mounted atop a cylinder block 180. Pumps 140, 150 are in fluid communication with the cylinder block 180. Pumps 140, 150 selectively supply fluid to the cylinder block 180 upon command. Cooling system 120 includes a control system (e.g., like the control system 840 shown in FIG. 8). Control system governs the performance of pumps 140 and 150.

Pumps 140, 150 are configured in a parallel arrangement with respect to each other. In this configuration pumps 140, 150 provide greater flexibility and capability with respect to fluid flow rate. Fluid pressure is not necessarily increased at the same rate that flow rate is increased. Engines with greater flow demands than pressure requirements can utilize the shown cooling system 120. Fluid is circulated from the cylinder block 180 to cylinder heads 160, 170. Fluid can be directed in a direction opposite of a natural flow of fluid in a backflowing process.

The fluid exiting the engine 130 is provided to a heater core 190. Heater core 190 can add or remove thermal energy from fluid. Heater core 190 can be controlled by a control unit that can be the same or separate from the cooling system control unit. In one embodiment, a heater control valve is connected to the control unit and used to control the heater core 190. In another exemplary embodiment, a fan or blender is used to control the heater core 190. Heater 190 can be any standard heater known within the field, e.g., radiator. Fluid dispensed from the heater core is directed back into pumps 140, 150.

A thermostat 200 is included in the cooling system 120. The thermostat 200 is in fluid communication with an engine radiator 210. Thermostat 200 controls flow to the radiator 210 to remove excess heat from the fluid. Thermostat 200 can be any standard thermostat known within the field.

In the illustrated embodiment, thermostat 200 can be in communication with temperature sensors (e.g., 195, 205 as shown in FIG. 2) configured to gauge the temperature of fluid. In the shown embodiment, sensor 195 is configured to measure the temperature of fluid in the cylinder head. Sensor 205 is configured to measure fluid on the hot side of the engine as it exits the engine block. Sensors 195, 205 can be placed at various points with respect to the engine, including but not limited to the hot/cold sides of the engine, the cylinder head or locations with oil traveling therethrough. For example, temperature sensors can measure the temperature of fluid exiting the engine radiator. In one embodiment, the control unit governs the performance of pumps 140 and 150 according to the temperature readings from the temperature sensor. For example, if the fluid exiting engine 130 exceeds a predetermined threshold temperature of 100° C. pumps can be instructed to increase their flow output. Where the temperature of fluid drops below another predetermined temperature (e.g., 70° C.) one or more pumps 140, 150 can performed at a reduced speed, flow or power level. In another example, a temperature sensor measures the temperature of the cylinder heads 160, 170. Where the cylinder heads 160, 170 exceed a temperature of 400° C. pumps can be instructed to increase their flow output.

In the shown embodiment, a fluid reservoir 220 is provided. The fluid reservoir 220 is in fluid communication with the cooling system 120 through the engine radiator 210. When desired, fluid in reservoir 220 is circulated to the engine radiator 210. Engine radiator 210 is in fluid communication with thermostat 200. Engine radiator 210 can be any type of radiator known within the field.

Figure 3:
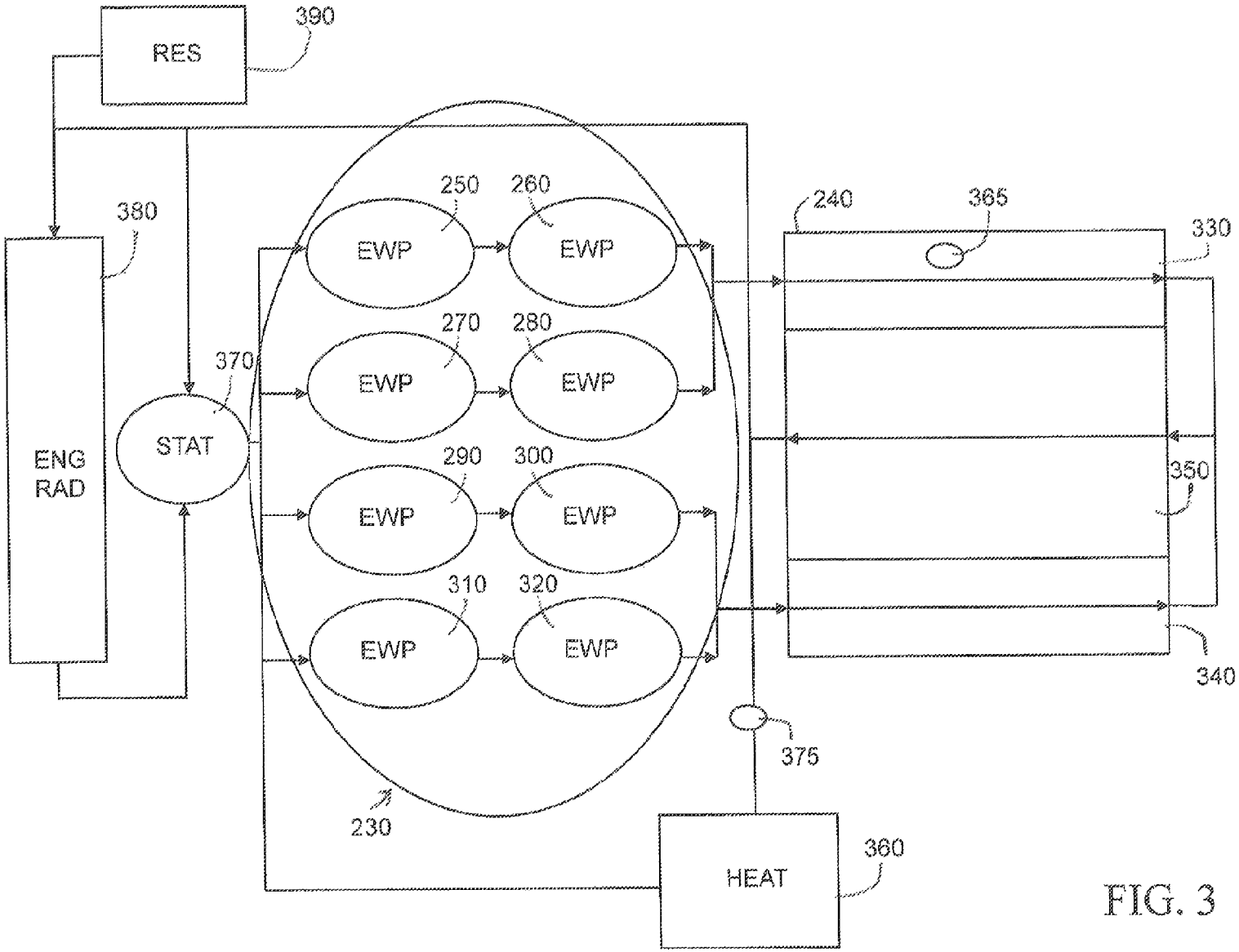
FIG. 3 is a schematic depiction of a cooling system and internal combustion engine according to an exemplary embodiment of the present invention.

With reference to FIG. 3, there is shown a cooling system 230 and internal combustion engine 240. Cooling system 230 provides greater flexibility and control of the thermal conditions of the engine 240 during operation than contemporary designs with singular and/or mechanical water pumps. The illustrated cooling system 230 utilizes water as a coolant, other lubricants or coolants can be employed with the present teachings. E.g., in one embodiment, oil or antifreeze is utilized with the cooling system 230.

Cooling system 230, as shown in FIG. 3, includes eight electrical water pumps (or "EWPs") 250, 260, 270, 280, 290, 300, 310 and 320. Engine 240 is a v-type engine such as a V-8. Engine includes a first cylinder head 330 and second cylinder head 340. The cylinder heads 330, 340 are mounted atop a cylinder block 350. Each cylinder head 330, 340 has a pump dedicated to that cylinder. Pumps 250, 260, 270, and 280 are in fluid communication with the first cylinder head 330 and provide fluid to a first, second, third and fourth cylinder. Pumps 250, 260, 270, and 280 selectively supply fluid to the cylinders in the first cylinder head 330 upon command. Pumps 290, 300, 310 and 320 are configured to provide fluid to the second cylinder head 340 that includes a fifth, sixth, seventh and eight cylinder. Cooling system 230 includes a control system (e.g., like the control system 840 shown in FIG. 8). Control system governs the performance of pumps 250, 260, 270, 280, 290, 300, 310 and 320. In another embodiment, each cylinder has a pump dedicated to the cylinder.

Pumps 250, 270, 290 and 310 are configured in a parallel arrangement with respect to each other. Pumps 250 and 260, 270 and 280, 290 and 300, as well as 310 and 320 are configured in series with respect to each other. In this configuration pumps 250, 260, 270, 280, 290, 300, 310 and 320 provide greater flexibility and capability with respect to fluid flow rate and pressure. Pumps 250, 260, 270, 280, 290, 300, 310 and 320 can be selectively turned off so that fluid pressure is not necessarily increased at the same rate that flow rate is increased or vice versa. In one embodiment, the engine 240 is a displacement-on-demand (or DOD) engine. Control unit is configured to control the pumps 250, 260, 270, 280, 290, 300, 310 and 320 according to the number of cylinders the engine 240 is operating. Where the engine 240 is only utilizing four cylinders, four pumps or less are providing fluid to the engine.

Cooling system 230 can also be configured so that each cylinder head 330, 340 can have the same or different numbers of pumps operating simultaneously. In one arrangement, only two pumps are operating on each cylinder head 330, 340. In another arrangement, cylinder head 330 has three pumps operating while cylinder head 340 has only two pumps operating. Where it is desirable to increase the flow rate in cylinder head 330 pump 250 can operate in conjunction with pumps 270 and/or 280. When it is desirable to increase the pressure in cylinder head 330 pump 250 can be operated in conjunction with pump 260. Control unit is configured to alter the performance of each pump as a function of engine or transmission operation.

Fluid is circulated through the cylinder block 350 from the cylinder heads 330, 340. In FIG. 3, the cooling system 230 is configured to directly supply fluid to the cylinder head 330 and backflow fluid through the cylinder block 350.

The fluid exiting the engine is provided to a heater core 360. Heater core 360 can add or remove thermal energy from fluid. Heater core 360 can be controlled by a control unit that can be the same or separate from the cooling system control unit. In one embodiment, a heater control valve is connected to the control unit and used to control the heater core 360. In another exemplary embodiment, a fan or blender is used to control the heater core 360. Heater 360 can be any standard heater known within the field, e.g., radiator. Fluid dispensed from the heater core 360 is directed back into pumps 250, 260, 270, 280, 290, 300, 310 and 320.

A thermostat 370 is included in the cooling system 230. The thermostat 370 is in fluid communication with an engine radiator 380. Thermostat 370 controls flow to the radiator 380 to remove excess heat from the fluid. Thermostat 370 can be any standard thermostat known within the field.

In the illustrated embodiment, thermostat 370 can be in communication with temperature sensors (e.g., 365, 375 as shown in FIG. 3) configured to gauge the temperature of fluid. In the shown embodiment, sensor 365 is configured to measure the temperature of fluid in the cylinder head. Sensor 375 is configured to measure fluid on the hot side of the engine as it exits the engine block. Sensors 365, 375 can be placed at various points with respect to the engine, including but not limited to the hot/cold sides of the engine, the cylinder head or locations with oil traveling therethrough. For example, temperature sensors can measure the temperature of fluid exiting the engine radiator. In one embodiment, the control unit governs the performance of pumps 250, 260, 270, 280, 290, 300, 310 and 320 according to the temperature readings from the temperature sensor. For example, if the fluid exiting engine 240 exceeds a predetermined threshold temperature of 110° C. pumps can be instructed to increase their flow output. Where the temperature of fluid drops below another predetermined temperature (e.g., 75° C.) one or more pumps 250, 260, 270, 280, 290, 300, 310 or 320 can performed at a reduced speed, flow or power level. In another example, a temperature sensor measures the temperature of the cylinder heads 330, 340. Where the cylinder heads 330, 340 exceed a temperature of 350° C. pumps can be instructed to increase their flow output.

In the shown embodiment, a fluid reservoir 390 is provided. The fluid reservoir 390 is in fluid communication with the cooling system 230 through the engine radiator 380. When desired, fluid in reservoir is circulated to the engine radiator 380. Engine radiator 380 is in fluid communication with thermostat 370. Engine radiator 380 can be any type of radiator known within the field.

Figure 4:
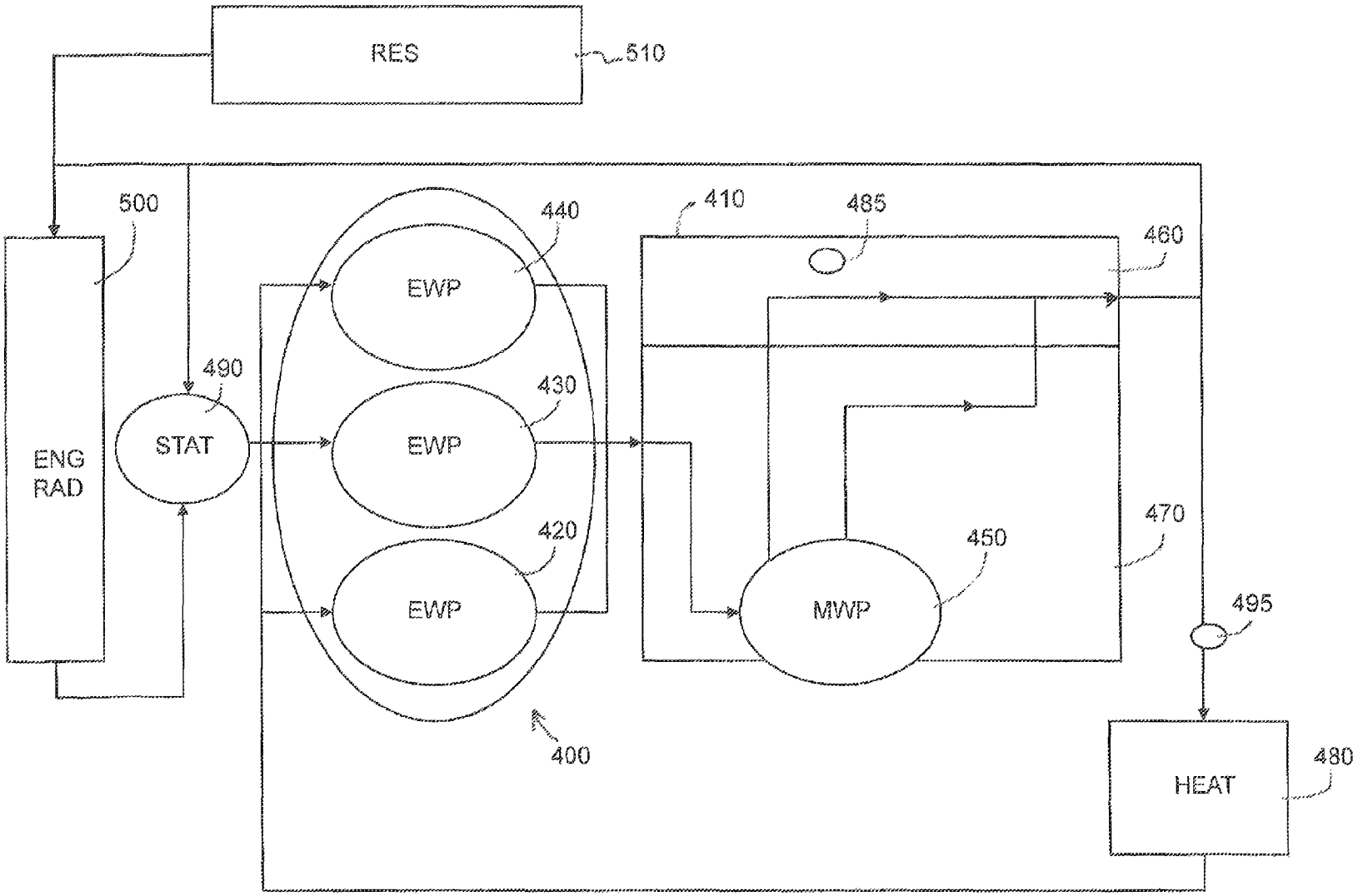
FIG. 4 is a schematic depiction of a cooling system and internal combustion engine according to an exemplary embodiment of the present invention.

With reference to FIG. 4, there is shown a cooling system 400 and internal combustion engine 410. The illustrated cooling system utilizes water as a coolant, other lubricants or coolants can be employed with the present teachings. E.g., in one embodiment, oil or antifreeze is utilized with the cooling system 400.

Cooling system 400, as shown in FIG. 4, includes three electrical water pumps 420, 430 and 440 arranged in parallel with respect to each other. A mechanical water pump 450 (or "MWP") is also provided, arranged in series with respect to the electric water pumps 420, 430 and 440. Engine 410 is an in-line engine (e.g., an I-4). Engine 410 includes a cylinder head 460 and cylinder block 470. Pumps 420, 430 and 440 are in fluid communication with the cylinder block 470. Cooling system 400 includes a control system (e.g., like the control system 840 shown in FIG. 8). Control system governs the performance of pumps 420, 430 and 440.

Pumps 420, 430 and 440 are configured in a parallel arrangement with respect to each other. In this configuration pumps 420, 430 and 440 provide greater flexibility and capability with respect to fluid flow rate. Fluid pressure is not necessarily increased at the same rate that flow rate is increased. Engines with greater flow demands than pressure requirements can utilize the shown cooling system 400. Pumps 420, 430 and 460 can be auxiliary pumps configured to increase the aggregate pressure of the cooling system 400 under predetermined circumstances.

Mechanical water pump 450 receives fluid from pumps 420, 430 and 440. Pump 450 is located in the cylinder block 470. Pump 450 directs fluid to the cylinder head 460 of the engine 410. Pump 450 can be any mechanical fluid pump known within the field.

The fluid exiting the engine 410 is provided to a heater core 480. Heater core 480 can add or remove thermal energy from fluid. Heater core 480 can be controlled by a control unit that can be the same or separate from the cooling system control unit. In one embodiment, a heater control valve is connected to the control unit and used to control the heater core 480. In another exemplary embodiment, a fan or blender is used to control the heater core 480. Heater 480 can be any standard heater known within the field, e.g., radiator. Fluid dispensed from the heater core 480 is directed back into pumps 420, 430 and 440.

A thermostat 490 is included in the cooling system 400. The thermostat 490 is in fluid communication with an engine radiator 500. Thermostat 490 controls flow to the radiator 500 to remove excess heat from the fluid. Thermostat 490 can be any standard thermostat known within the field.

In the illustrated embodiment, thermostat 490 can be in communication with temperature sensors (e.g., 485, 495 as shown in FIG. 4) configured to gauge the temperature of fluid. In the shown embodiment, sensor 485 is configured to measure the temperature of fluid in the cylinder head. Sensor 495 is configured to measure fluid on the hot side of the engine as it exits the cylinder head. Sensors 485, 495 can be placed at various points with respect to the engine, including but not limited to the hot/cold sides of the engine, the cylinder head or locations with oil traveling therethrough. For example, temperature sensors can measure the temperature of fluid exiting the engine radiator. In one embodiment, the control unit governs the performance of pumps 420, 430 and 440 according to the temperature readings from the temperature sensor. For example, if the fluid exiting engine 410 exceeds a predetermined threshold temperature of 110° C. pumps can be instructed to increase their flow output. Where the temperature of fluid drops below another predetermined temperature (e.g., 75° C.) one or more pumps 420, 430 and 440 can performed at a reduced speed, flow or power level. In another example, a temperature sensor measures the temperature of the cylinder head 460. Where the cylinder head 460 exceeds a temperature of 350° C. pumps can be instructed to increase their flow output.

In the shown embodiment, a fluid reservoir 510 is provided. The fluid reservoir 510 is in fluid communication with the cooling system through the engine radiator 500. When desired, fluid in reservoir 510 is circulated to the engine radiator 500. Engine radiator 500 is in fluid communication with thermostat 490. Engine radiator 500 can be any type of radiator known within the field.

Figure 5:
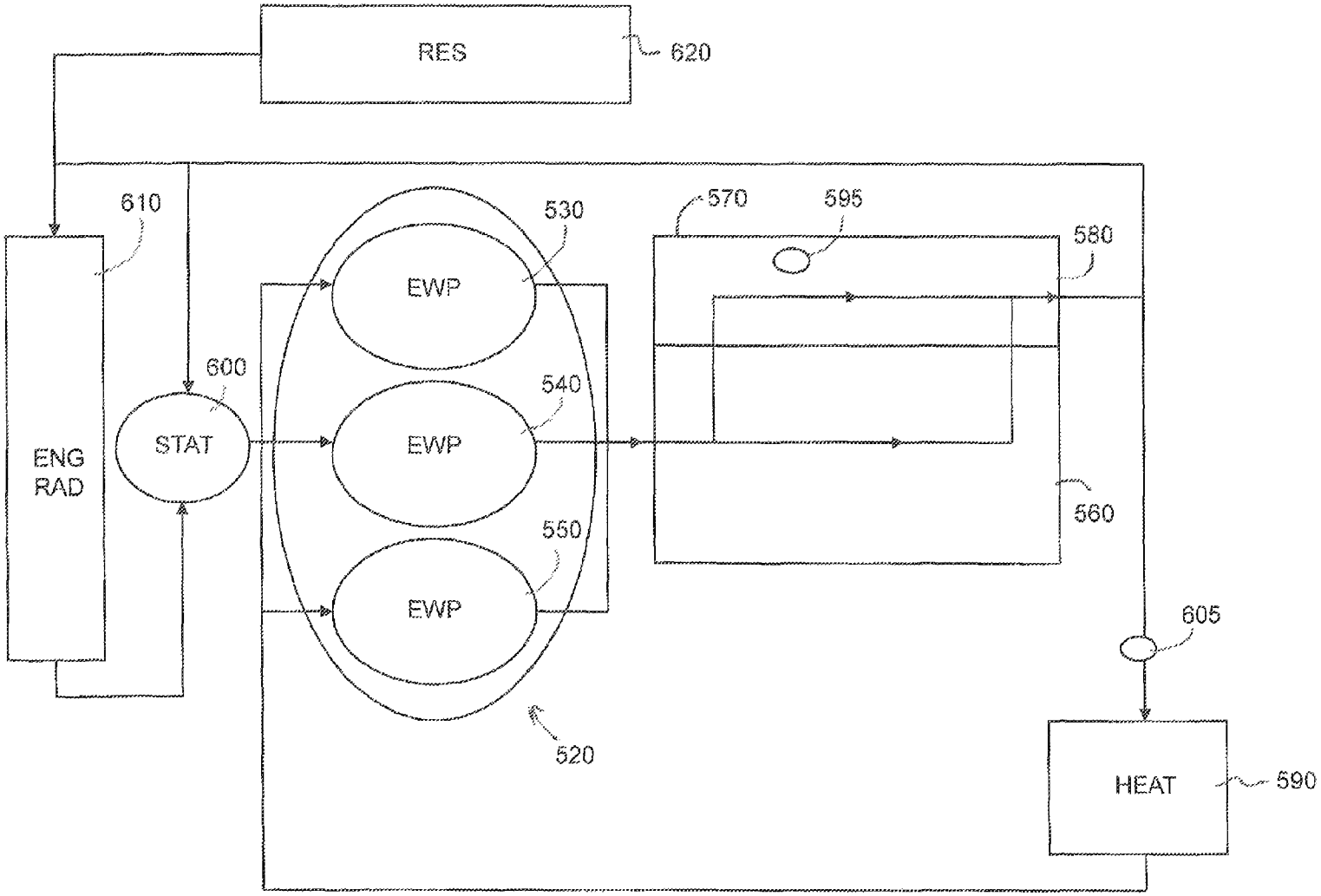
FIG. 5 is a schematic depiction of a cooling system and internal combustion engine according to an exemplary embodiment of the present invention.

Cooling system 520 shown in FIG. 5 is similar to the cooling system 400 shown in FIG. 4. Cooling system 520 includes three electrical water pumps 530, 540, and 550 arranged in parallel with respect to each other. Cooling system 520 does not include a mechanical water pump like cooling system shown in FIG. 4. Pumps 530, 540, and 550 supply fluid directly into the cylinder block 560 of the engine 570. Fluid is directed into the cylinder head 580 from the cylinder block by pumps 530, 540, and 550. Cooling system 520 provides reduced pressure capabilities with respect to cooling system 400, of FIG. 4. Cooling system 520 requires fewer parts and provides a lower cost alternative to cooling system 400.

The fluid exiting the engine 570 is provided to a heater core 590. Heater core 590 can add or remove thermal energy from fluid. Heater core 590 can be controlled by a control unit that can be the same or separate from the cooling system control unit. In one embodiment, a heater control valve is connected to the control unit and used to control the heater core 590. In another exemplary embodiment, a fan or blender is used to control the heater core 590. Heater 590 can be any standard heater known within the field, e.g., radiator. Fluid dispensed from the heater core is directed back into pumps 530, 540, and 550.

A thermostat 600 is included in the cooling system 520. The thermostat 600 is in fluid communication with an engine radiator 610. Thermostat 600 controls flow to the radiator 610 to remove excess heat from the fluid. Thermostat 600 can be any standard thermostat known within the field.

In the illustrated embodiment, thermostat 600 can be in communication with temperature sensors (e.g., 595, 605 as shown in FIG. 5) configured to gauge the temperature of fluid. In the shown embodiment, sensor 595 is configured to measure the temperature of fluid in the cylinder head. Sensor 605 is configured to measure fluid on the hot side of the engine as it exits the cylinder head. Sensors 595, 605 can be placed at various points with respect to the engine, including but not limited to the hot/cold sides of the engine, the cylinder head or locations with oil traveling therethrough. For example, temperature sensors can measure the temperature of fluid exiting the engine radiator. In one embodiment, the control unit governs the performance of pumps 530, 540 and 550 according to the temperature readings from the temperature sensor. For example, if the fluid exiting engine 570 exceeds a predetermined threshold temperature of 112° C. pumps can be instructed to increase their flow output. Where the temperature of fluid drops below another predetermined temperature (e.g., 76° C.) one or more pumps 530, 540 or 550 can performed at a reduced speed, flow or power level. In another example, a temperature sensor measures the temperature of the cylinder head 580. Where the cylinder head 580 exceed a temperature of 250° C. pumps can be instructed to increase their flow output.

In the shown embodiment, a fluid reservoir 620 is provided. The fluid reservoir 620 is in fluid communication with the cooling system through the engine radiator 610. When desired, fluid in reservoir 620 is circulated to the engine radiator 610. Engine radiator 610 is in fluid communication with thermostat 600. Engine radiator 610 can be any type of radiator known within the field.

With reference to FIG. 6, there is shown a cooling system 630 and internal combustion engine 640. The illustrated cooling system 630 utilizes water as a coolant, other lubricants or coolants can be employed with the present teachings. E.g., in one embodiment, oil or antifreeze is utilized with the cooling system 630.

Cooling system 630, as shown in FIG. 6, includes two electrical water pumps 650, 660 arranged in series with respect to each other. A mechanical water pump (or "MWP") 670 is also provided, arranged in series with respect to the electric water pumps 650, 660. Engine 640 is an in-line engine (e.g., an I-4). Engine 640 includes a cylinder head 680 and cylinder block 690. Pumps 650, 660 are in fluid communication with the cylinder block 690. Cooling system 630 includes a control system (e.g., like the control system 840 shown in FIG. 8). Control system 630 governs the performance of pumps 650, 660.

Pumps 650, 660 are configured in a series arrangement with respect to each other. In this configuration pumps 650, 660 provide greater flexibility and capability with respect to fluid pressure. Fluid flow rate is not necessarily increased at the same rate that flow pressure is increased. Engines with greater pressure demands than pressure requirements can utilize the shown cooling system 630. Pumps 650 and 660 can be auxiliary pumps configured to increase the aggregate pressure of the cooling system 630 under predetermined circumstances.

Mechanical water pump 670 receives fluid from pumps 650, 660. Pump 670 is located in the cylinder block 690. Pump 670 directs fluid to the cylinder head 680 of the engine 640. Pump 670 can be any mechanical fluid pump known within the field.

The fluid exiting the engine 640 is provided to a heater core 700. Heater core 700 can add or remove thermal energy from fluid. Heater core 700 can be controlled by a control unit that can be the same or separate from the cooling system control unit. In one embodiment, a heater control valve is connected to the control unit and used to control the heater core 700. In another exemplary embodiment, a fan or blender is used to control the heater core 700. Heater 700 can be any standard heater known within the field, e.g., radiator. Fluid dispensed from the heater core is directed back into pumps 650, 660.

A thermostat 710 is included in the cooling system 630. The thermostat 710 is in fluid communication with an engine radiator 720. Thermostat 710 controls flow to the radiator 720 to remove excess heat from the fluid. Thermostat 710 can be any standard thermostat known within the field.

In the illustrated embodiment, thermostat 710 can be in communication with temperature sensors (e.g., 705, 715 as shown in FIG. 6) configured to gauge the temperature of fluid. In the shown embodiment, sensor 705 is configured to measure the temperature of fluid in the cylinder head. Sensor 715 is configured to measure fluid on the hot side of the engine as it exits the cylinder head. Sensors 705, 715 can be placed at various points with respect to the engine, including but not limited to the hot/cold sides of the engine, the cylinder head or locations with oil traveling therethrough. For example, temperature sensors can measure the temperature of fluid exiting the engine radiator. In one embodiment, the control unit governs the performance of pumps 650 and 660 according to the temperature readings from the temperature sensor. For example, if the fluid exiting engine 640 exceeds a predetermined threshold temperature of 105° C. pumps can be instructed to increase their flow output. Where the temperature of fluid drops below another predetermined temperature (e.g., 70° C.) one or more pumps 650 or 660 can performed at a reduced speed, flow or power level. In another example, a temperature sensor measures the temperature of the cylinder head 680. Where the cylinder head 680 exceeds a temperature of 250° C. pumps can be instructed to increase their flow output.

In the shown embodiment, a fluid reservoir 730 is provided. The fluid reservoir 730 is in fluid communication with the cooling system 630 through the engine radiator 720. When desired, fluid in reservoir 730 is circulated to the engine radiator 720. Engine radiator 720 is in fluid communication with thermostat 710. Engine radiator 720 can be any type of radiator known within the field.

Cooling system 740 shown in FIG. 7 is similar to the cooling system 630 disclosed in FIG. 6. Cooling system 740 includes two electrical water pumps 750, 760 arranged in series with respect to each other. Cooling system 740 does not include a mechanical water pump like cooling system 630 shown in FIG. 6. Pumps 750, 760 supply fluid directly into the cylinder block 770 of the engine 780. Fluid is directed into the cylinder 790 head from the cylinder block by pumps 750, 760. Cooling system 740 provides reduced pressure capabilities with respect to cooling system 630 of FIG. 6. Cooling system 740 requires fewer parts and provides a lower cost alternative to cooling system 630.

The fluid exiting the engine 780 is provided to a heater core 800. Heater core 800 can add or remove thermal energy from fluid. Heater core 800 can be controlled by a control unit that can be the same or separate from the cooling system control unit. In one embodiment, a heater control valve is connected to the control unit and used to control the heater core 800. In another exemplary embodiment, a fan or blender is used to control the heater core 800. Heater 800 can be any standard heater known within the field, e.g., radiator. Fluid dispensed from the heater core is directed back into pumps 750, 760.

A thermostat 810 is included in the cooling system 740. The thermostat 810 is in fluid communication with an engine radiator 820. Thermostat 810 controls flow to the radiator 820 to remove excess heat from the fluid. Thermostat 810 can be any standard thermostat known within the field.

In the illustrated embodiment, thermostat 810 can be in communication with temperature sensors (e.g., 805, 815 as shown in FIG. 7) configured to gauge the temperature of fluid. In the shown embodiment, sensor 805 is configured to measure the temperature of fluid in the cylinder head. Sensor 815 is configured to measure fluid on the hot side of the engine as it exits the cylinder head. Sensors 805, 815 can be placed at various points with respect to the engine, including but not limited to the hot/cold sides of the engine, the cylinder head or locations with oil traveling therethrough. For example, temperature sensors can measure the temperature of fluid exiting the engine radiator. In one embodiment, the control unit governs the performance of pumps 750 and 760 according to the temperature readings from the temperature sensor. For example, if the fluid exiting engine 780 exceeds a predetermined threshold temperature of 110° C. pumps can be instructed to increase their flow output. Where the temperature of fluid drops below another predetermined temperature (e.g., 75° C.) one or more pumps 750 or 760 can performed at a reduced speed, flow or power level. In another example, a temperature sensor measures the temperature of the cylinder head 790. Where the cylinder head 790 exceeds a temperature of 350° C. pumps can be instructed to increase their flow output.

In the shown embodiment, a fluid reservoir 830 is provided. The fluid reservoir 830 is in fluid communication with the cooling system through the engine radiator 820. When desired, fluid in reservoir 830 is circulated to the engine radiator 820. Engine radiator 820 is in fluid communication with thermostat 810. Engine radiator 820 can be any type of radiator known within the field.

With reference to FIG. 8 a cooling system 840 is shown with an inline engine 850. Cooling system 840 includes two electrical water pumps 860, 870 arranged in parallel with respect to each other. The cooling system 840 includes two separate cooling circuits. The first circuit includes an electric water pump 860 configured to supply fluid to the cylinder head 880 of the engine. In the shown embodiment, fluid is returned to the fluid reservoir 890 after exiting the cylinder head 880. A fluid return channel or bank 900 runs from the cylinder head 880 to the fluid reservoir 890. Fluid can be combined and returned to the fluid reservoir 890 or a heater core 910 after exiting the cylinder head 880. The second circuit includes an electric water pump 870 which is configured to supply fluid to the cylinder block 920. In the shown embodiment, fluid is returned to the fluid reservoir 890 after exiting the engine block 920. A fluid return channel 930 runs from the cylinder block 920 to the heater core 910. Fluid can be combined and returned to the heater core 910 or fluid reservoir 890 after exiting the cylinder block 920. In the shown embodiment, the cooling system 840 includes at least two fluid return channels (or banks) 900 and 930. Cooling system 840 enables greater temperature control between the cylinder head 880 and cylinder block 920. Greater efficiencies can be obtained by cooling system 840 as pump 860 or 870 can perform according to the needs of the cylinder head 880 and cylinder block 920, respectively. Where the cylinder head 880 requires less cooling than the cylinder block 920, pump 860 can perform at a reduced power level. Vice versa, where the cylinder block 920 requires less cooling than the cylinder head 880, pump 870 can perform at a reduced power level.

Heater core 910 can add or remove thermal energy from fluid. Heater core 910 can be controlled by a control unit that can be the same or separate from the cooling system control unit. In one embodiment, a heater control valve is connected to the control unit and used to control the heater core 910. In another exemplary embodiment, a fan or blender is used to control the heater core 910. Heater 910 can be any standard heater known within the field, e.g., radiator. Fluid dispensed from the heater core is directed back into pumps 860, 870.

A thermostat 940 is included in the cooling system 840. The thermostat 940 is in fluid communication with an engine radiator 950. Thermostat 940 controls flow to the radiator 950 to remove excess heat from the fluid. Thermostat 940 can be any standard thermostat known within the field.

In the illustrated embodiment, thermostat 940 can be in communication with temperature sensors (e.g., 935, 945 as shown in FIG. 8) configured to gauge the temperature of fluid. In the shown embodiment, sensor 935 is configured to measure the temperature of fluid in the cylinder head. Sensor 945 is configured to measure fluid on the hot side of the engine as it exits the engine block. Sensors 935, 945 can be placed at various points with respect to the engine, including but not limited to the hot/cold sides of the engine, the cylinder head or locations with oil traveling therethrough. For example, temperature sensors can measure the temperature of fluid exiting the engine radiator. In one embodiment, the control unit governs the performance of pumps 860 and 870 according to the temperature readings from the temperature sensor. For example, if the fluid exiting engine 850 exceeds a predetermined threshold temperature of 100° C. pumps can be instructed to increase their flow output. Where the temperature of fluid drops below another predetermined temperature (e.g., 70° C.) one or more pumps 860 or 870 can performed at a reduced speed, flow or power level. In another example, a temperature sensor measures the temperature of the cylinder head 880. Where the cylinder head 880 exceeds a temperature of 300° C. pumps can be instructed to increase their flow output.

Fluid reservoir 890 is in fluid communication with the cooling system 840 through the engine radiator 950. When desired, fluid in reservoir 890 is circulated to the engine radiator 950. Engine radiator 950 is in fluid communication with thermostat 940. Engine radiator 950 can be any type of radiator known within the field.

Figure 9:
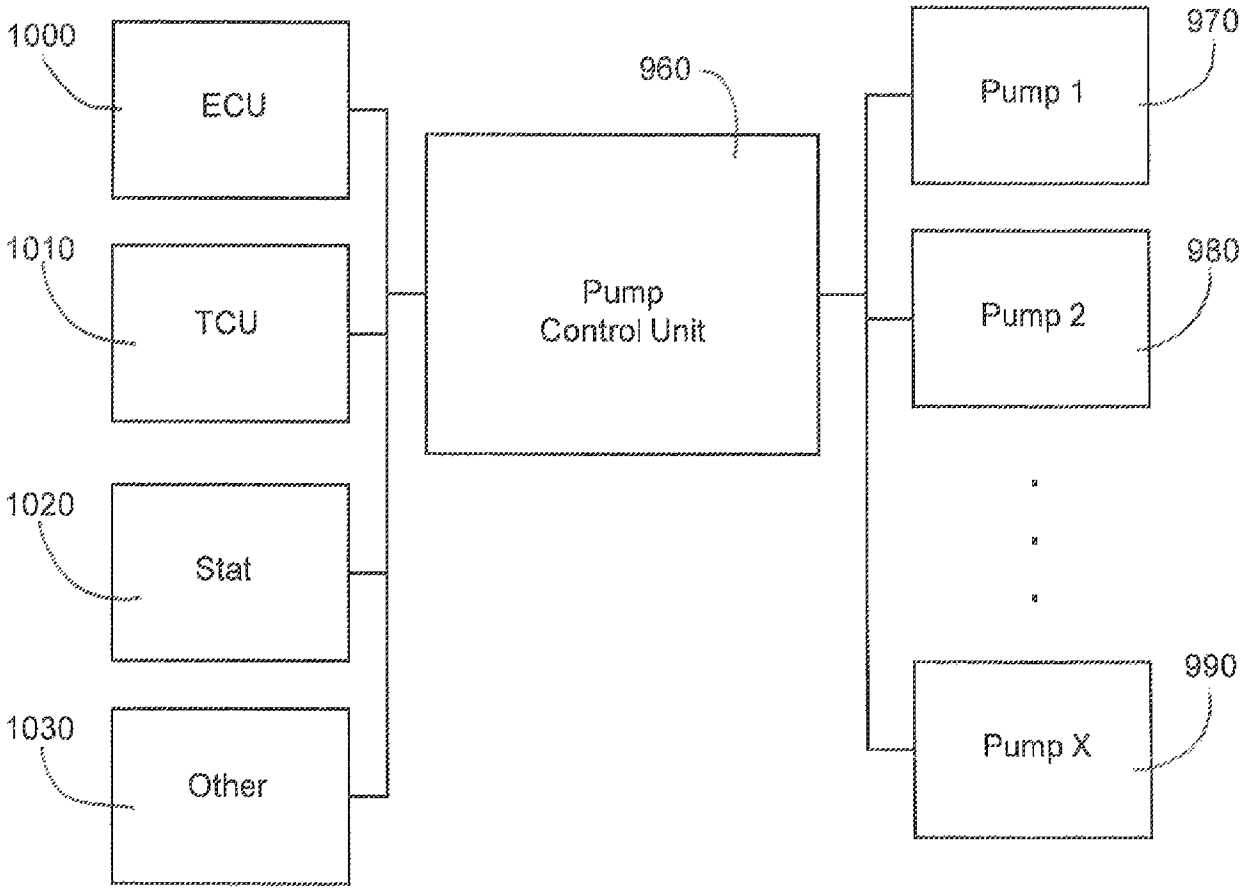
FIG. 9 is a schematic depiction of a control unit for a cooling system according to an exemplary embodiment of the present invention.

With reference to FIG. 9, a control unit 960 is shown. Control unit 960 can be compatible with any of the exemplary cooling systems 10, 120, 230, 400, 520, 630, 740, and 840 disclosed herein. Control unit 960 is in communication with a number of electronic pumps 970, 980, and 990. In the shown embodiment, control unit 960 is in communication with the engine control unit (or "ECU") 1000, transmission control unit (or "TCU") 1010, thermostat 1020, and other vehicle controllers e.g., 1030. Control unit 960 is configured to alter the performance of each pump as a function of engine or transmission operation. In one embodiment, control unit 960 governs at least one of the pumps 970, 980 or 990 as a function of engine flow demand. Control unit 960 receives a signal from ECU 1000 as to the engine flow requirements of the engine. Where the engine requires an increased flow, pumps 970, 980 and 990 can increase the power level at which they operate. In one embodiment, pumps 970, 980 and 990 can operate in either series or parallel, as shown in FIG. 3. Where the engine requires an increased flow, pumps 970, 980 and/or 990 are instructed to operate in series with respect to each other. Where engine requires an increase pressure demand, pumps 970, 980 and/or 990 are instructed to operate in parallel with respect to each other. ECU 1000 is also configured to provide a signal indicative of engine operating speed. Pumps 970, 980 and/or 990 can be governed as a function of engine speed as well.

Control unit 960 is in communication with thermostat 1020. Thermostat 1020 is configured to send an electronic signal indicative of the temperature of the fluid. In one embodiment, control unit 960 has control algorithm that governs pump performance as a function of fluid temperature. Some exemplary thermal conditions are disclosed hereinabove. Control unit 960 can be configured with a number of threshold temperatures. The performance of each pump 970, 980 and/or 990 can be altered at each threshold temperature.

In another embodiment, control unit 960 is configured to govern pump performance as a function of transmission speed. Control unit 960 is in communication with the transmission control unit 1010. TCU 1010 sends a signal to control unit indicative of transmission speed. In one example, the control unit 840 includes logic to increase the flow rate of fluid as the transmission speed or gears increases. In another embodiment, control unit 960 is configured to govern the pumps 970, 980 and/or 990 according to most efficient operating scenario. The most efficient scenario can be defined as the operating scenario that requires the lower power demands for the cooling system.

Figure 10:
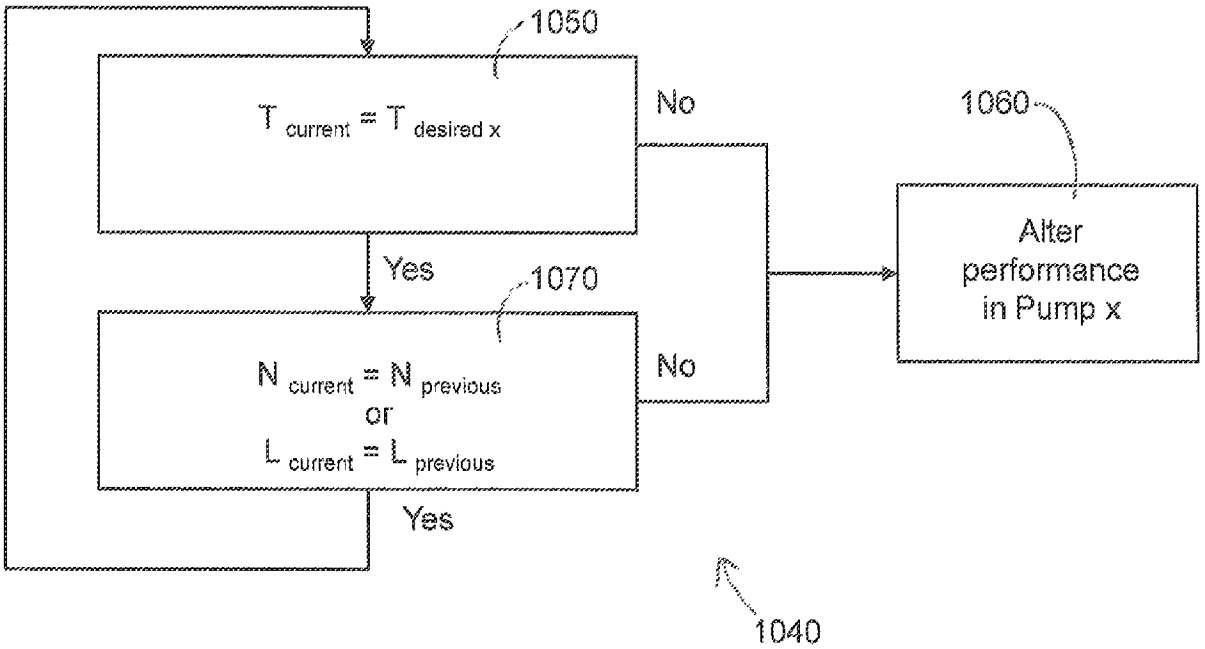
FIG. 10 is a flow chart of an algorithm for a pump control unit according to an exemplary embodiment of the present invention.

FIG. 10 illustrates an exemplary algorithm 1040 for a control unit. The control unit performs a series of checks on the cooling systems to determine what type of pump performance is needed for the cooling system. Initially, control unit is in communication with a thermostat or temperature sensor. Control unit checks the temperature of fluid 1050. If the measured temperature "T current" is equal to a threshold or desired temperature "Tdesired x" Pump x continues performing at the same level. Where the measured temperature is not equal to the desired temperature, the control unit alters the performance of Pump x, as shown at 1060. Control unit can reduce or increase pump performance.

At step 1070 control unit can check the speed of the engine or flow rate of the fluid. Control unit compares the current engine speed "N current" with a previously measured engine speed "N previous". Where the engine speed has changed, the control unit alters the performance in Pump x. Control unit can also check the flow rate of fluid at any point in the hydraulic circuit. The current flow rate "L current" is compared to a previous flow rate "L previous". Where the flow rate changes, the control unit alters the performance in Pump x. The algorithm 1040 is a closed loop program. Control unit continues to re-check the temperature at step 1050 once the program concludes.

Figure 11:
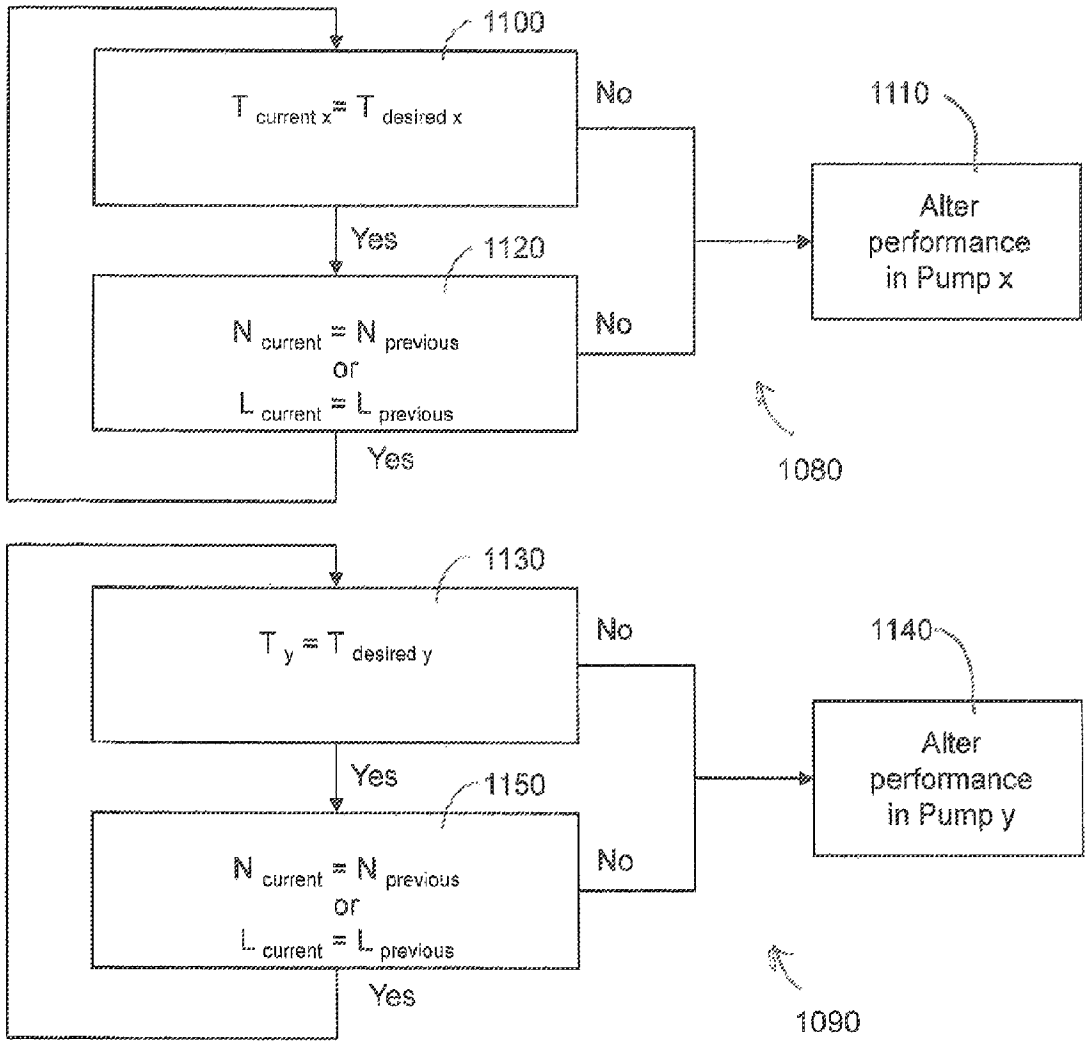
FIG. 11 is a flow chart of an algorithm for a pump control unit according to an exemplary embodiment of the present invention.

FIG. 11 illustrates two exemplary algorithms 1080, 1090 for a control unit governing pump performance in two separate hydraulic circuits. The control unit performs a series of checks on each hydraulic circuit to determine what type of pump performance is needed for the cooling system. The first algorithm 1080 is configured to control pumps that provide fluid to the cylinder head. The second algorithm 1090 is configured to control pumps that provide fluid to the cylinder block. Initially, control unit is in communication with a thermostat or temperature sensor associated with the cylinder head. Control unit checks the temperature of fluid 1100. If the measured temperature "T current" is equal to a threshold or desired temperature "Tdesired x" Pump x continues performing at the same level. Where the measured temperature is not equal to the desired temperature, the control unit alters the performance of Pump x, as shown at 1110. Control unit can reduce or increase pump performance. At step 1120 control unit can check the speed of the engine or flow rate of the fluid. Control unit compares the current engine speed "N current" with a previously measured engine speed "N previous". Where the engine speed has changed, the control unit alters the performance in Pump x at 1110. Control unit can also check the flow rate of fluid at any point in the hydraulic circuit. The current flow rate "L current" is compared to a previous flow rate "L previous". Where the flow rate changes, the control unit alters the performance in Pump x. The algorithm 1080 is a closed loop program. Control unit continues to re-check the temperature at step 1100 once the program concludes.

Control unit is also in communication with a thermostat or temperature sensor associated with the cylinder block. Control unit checks the temperature of fluid 1130. If the measured temperature "T current" is equal to a threshold or desired temperature "Tdesired y" the Pump y continues performing at the same level. Where the measured temperature is not equal to the desired temperature, the control unit alters the performance of Pump y, as shown at 1140. Control unit can reduce or increase the pump performance. At step 1150 control unit can check the speed of the engine or flow rate of the fluid. Control unit compares the current engine speed "N current" with a previously measured engine speed "N previous". Where the engine speed has changed, the control unit alters the performance in Pump y. Control unit can also check the flow rate of fluid at any point in the hydraulic circuit. The current flow rate "L current" is compared to a previous flow rate "L previous". Where the flow rate changes, the control unit alters the performance in Pump y. The algorithm 1090 is a closed loop program. Control unit continues to re-check the temperature at step 1130 once the program concludes.

Figure 12:
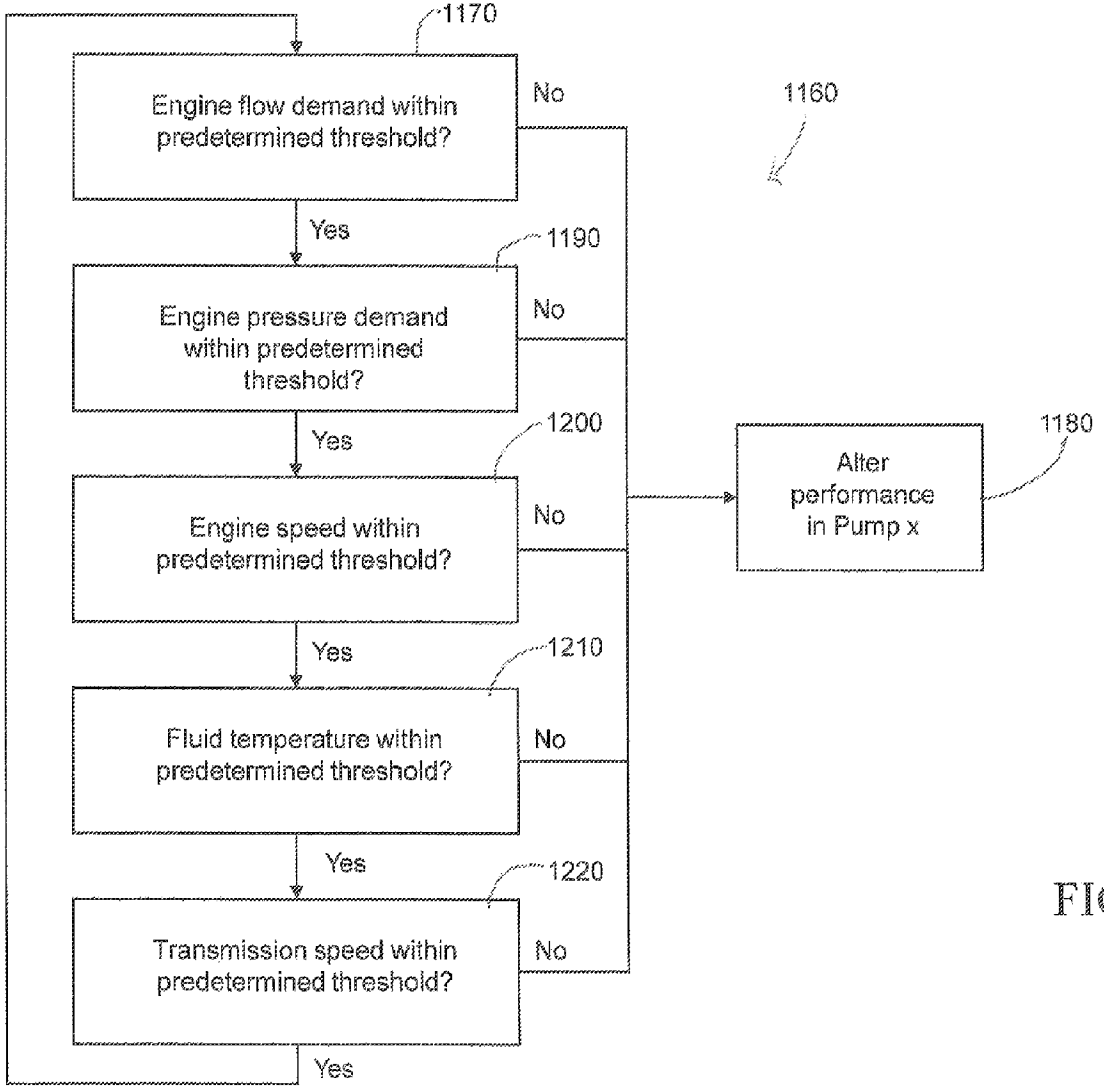
FIG. 12 is a flow chart of an algorithm for a pump control unit according to an exemplary embodiment of the present invention.

FIG. 12 illustrates another exemplary algorithm 1160 for a control unit. The control unit performs a series of checks on other systems to determine what type of pump performance is needed for the cooling system. Initially, control unit checks if engine flow demand is within a predetermined threshold 1170. If so, the control unit moves on to the next check. Where the engine flow demand is above a predetermined threshold, the control unit alters performance in one or more of the pumps in the cooling system 1180. For the next check, the control unit checks whether engine pressure is within a predetermined threshold 1190. If not, the control unit alters performance in one or more of the pumps in the cooling system 1180.

The control unit also checks the engine speed at 1200. If the engine speed is outside of a predetermined threshold, control unit alters performance in one or more of the pumps of the cooling system 1180. Control unit is in communication with a thermostat and checks whether the fluid is within a predetermined threshold 1210. When the fluid temperature is outside of a predetermined threshold, control unit alters performance in one or more of the pumps of the cooling system 1180. Control unit is also in communication with a transmission control unit. Control unit checks the transmission performance characteristics. In one embodiment, control unit checks the transmission speed 1220. If transmission speed is within a predetermined threshold, control unit proceeds to the next check 1170. If the transmission speed is outside of a predetermined threshold, control unit alters the performance in one or more of the pumps of the cooling system 1180. In the shown embodiment, the algorithm is a closed loop system. When control unit has performed all checks, the program re-starts and begins checking engine flow demand at 1170. In another, embodiment, the algorithm is not a closed loop system. The order of each check can be altered. In another embodiment, control unit governs the performance of pumps as a function of transmission speed and temperature alone. Control unit can include any number of known processors to accomplish the exemplary algorithms mentioned herein. Exemplary processors include 64- or 32-bit processors.

The order in which fluid is supplied to engine components can be altered and still be within the spirit of the present invention. For example, the cooling system 230 shown in FIG. 3 provides fluid to the cylinder head 330 first and then directs fluid to the cylinder block 350. Cooling system 230 can be configured to first provide fluid to the cylinder block 350 and then be routed to the cylinder heads 330 or 340. Alternative flow patterns can be utilized and still be within the spirit of the present invention(s).

The teachings of the present invention reduce the size of each individual pump to increase the flexibility of implementation in a vehicle. Overall packaging size and the electrical current drawn can be reduced. Another benefit of the present invention(s) is that it can reduce production costs. Ordering pumps in greater volumes can lead to lower individual part costs. The use of electric water pumps typically increases the aggregate flow and pressure in the system. In some arrangements, a smaller mechanical water pump can be utilized.

The invention has been described with reference to certain aspects. These aspects and features illustrated in the drawings can be employed alone or in combination. Modifications and alterations will occur to others upon a reading and understanding of this specification. Although the described aspects discuss electric water pumps as one material of construction, it is understood that other types of pumps can be used for selected components if so desired. It is understood that mere reversal of components that achieve substantially the same function and result are contemplated, e.g., increasing the pressure output or flow rate of fluid can be achieved by different configurations without departing from the present invention. It is intended to include all such modifications and alterations insofar as they come within the scope of the appended claims or the equivalents thereof. Moreover, those familiar with the art to which this invention relates will recognize various alternative designs and embodiments for practicing the invention within the scope of the appended claims.

We claim:

1. A cooling system for an internal combustion engine, the internal combustion engine having a cylinder block and cylinder head, the system comprising:

a first pump in fluid communication with the engine, the first pump being an electric pump;

a second pump in fluid communication with the engine, the second pump being an electric pump;

a third pump arranged in parallel with at least one of the first and second pump;

a control unit that governs the first pump and second pump;

at least two fluid return channels configured to recirculate coolant to the pumps; and wherein the first pump is configured to supply coolant to the cylinder head;

wherein the second pump is configured to supply coolant to the cylinder block;

wherein the first and second pumps are arranged to backflow coolant through the engine.

2. A cooling system for an internal combustion engine, the internal combustion engine having a cylinder block and cylinder head, the system comprising:

a first pump in fluid communication with the engine, the first pump being an electric pump;

a second pump in fluid communication with the engine, the second pump being an electric pump;

a third pump, the third pump being a mechanical pump;

a control unit that governs the first pump and the second pump; and at least two fluid return channels configured to recirculate coolant to the pumps;

wherein the first pump is configured to supply coolant to the cylinder head;

wherein the second pump is configured to supply coolant to the cylinder block;

wherein the first and second pumps are arranged to backflow coolant through the engine.

3. The system of claim 2, wherein the control unit governs at least one of the first pump and second pump as a function of engine operation.

4. The system of claim 3, wherein the control unit governs at least one of the first pump and second pump as a function of engine flow demand.

5. The system of claim 3, wherein the control unit governs at least one of the first pump and second pump as a function of engine pressure demand.

6. The system of claim 3, wherein the control unit governs at least one of the first pump and second pump as a function of engine speed.

7. The system of claim 2, wherein the control unit governs at least one of the first pump and second pump as a function of coolant temperature.

8. The system of claim 2, wherein the control unit governs at least one of the first pump and second pump as a function of a transmission speed.

9. The system of claim 2, wherein the first and second pump are arranged in parallel.

10. The system of claim 9, further comprising a third pump arranged in series with at least one of the first and second pump.

11. The system of claim 2, wherein the engine comprises a plurality of cylinders and wherein the cooling system, wherein the third pump is to supply coolant to at least one of the cylinders.

12. The system of claim 11, wherein the cooling system includes at least one pump for each cylinder in the plurality of cylinders, each pump configured to supply coolant to a respective cylinder.

13. A cooling system for an internal combustion engine, comprising:

at least three electrical water pumps arranged in parallel with respect to each other and configured to provide water to the ICE;

a mechanical water pump in fluid communication with the three electrical water pumps and configured to provide water to the ICE; and a control unit that governs the electrical water pumps.

14. The system of claim 13, wherein the control unit governs at least one of the three electric water pumps as a function of engine operation.

15. The system of claim 14, wherein the control unit governs at least one of the three electric water pumps as a function of engine flow demand.

16. The system of claim 14, wherein the control unit governs at least one of the three electric water pumps as a function of engine pressure demand.

17. The system of claim 14, wherein the control unit governs at least one of the three electric water pumps as a function of engine speed.

18. The system of claim 13, wherein the control unit governs at least one of the three electric water pumps as a function of water temperature.

19. The system of claim 13, wherein the control unit governs at least one of the three electric water pumps as a function of a transmission speed.

* * * * *